United States Patent [19]

Chiron et al.

[11] 4,027,253

[45] May 31, 1977

[54] NON-RECIPROCAL BROADBAND SLOT LINE DEVICE

[75] Inventors: Bernard Chiron; Michel de Vecchis, both of Paris Cedex, France

[73] Assignee: Societe Lignes Telegraphiques et Telephoniques, Paris, France

[22] Filed: May 15, 1974

[21] Appl. No.: 470,614

[30] Foreign Application Priority Data

May 18, 1973 France ..... 73.18044

[52] U.S. Cl. ..... 333/1.1; 333/24.2; 333/84 R

[51] Int. Cl.² ..... H01P 1/38; H01P 1/36

[58] Field of Search ..... 333/1.1, 24.1, 24.2, 333/84 R, 84 M

[56] References Cited

UNITED STATES PATENTS

| | | | |
|---|---|---|---|
| 3,602,845 | 1/1970 | Agrios et al. | 333/24.1 |
| 3,845,413 | 10/1974 | Chiron et al. | 333/1.1 |

*Primary Examiner*—Paul L. Gensler
*Attorney, Agent, or Firm*—Bacon & Thomas

[57] ABSTRACT

A broadband slot line non reciprocal microwave device which comprises a matched load placed on the face of a ferrite plate which is located within the microwave magnetic field of the slot line, said face being opposite to said slot and designed so that its height is larger than 3 times the width of the slot and its length is at least equal to a half wavelength as propagated within the slot at the maximum operating frequency. Said matched load may be a second slot line or a lossy ferrite plate. The device operates as an isolator with more than 20 dB isolation. It can be designed as a four port circulator.

13 Claims, 11 Drawing Figures

PRIOR ART
Fig:1
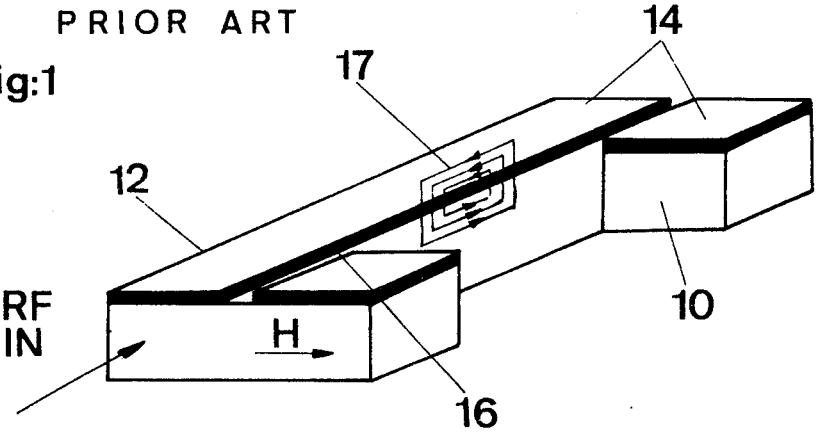
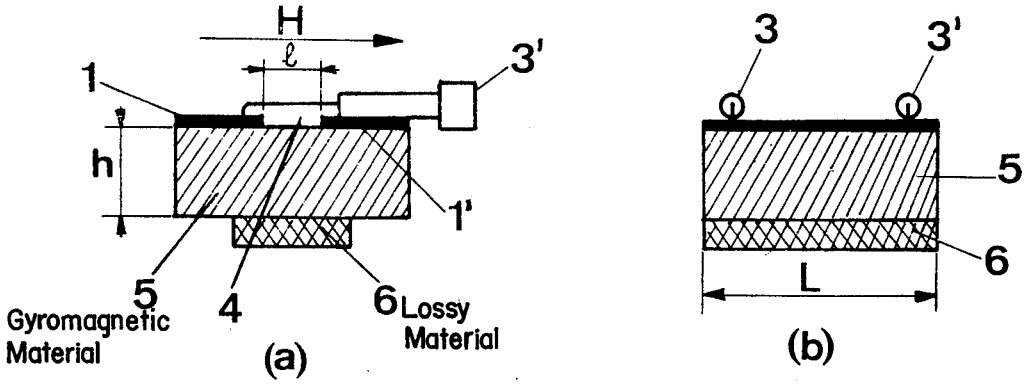
Fig:2
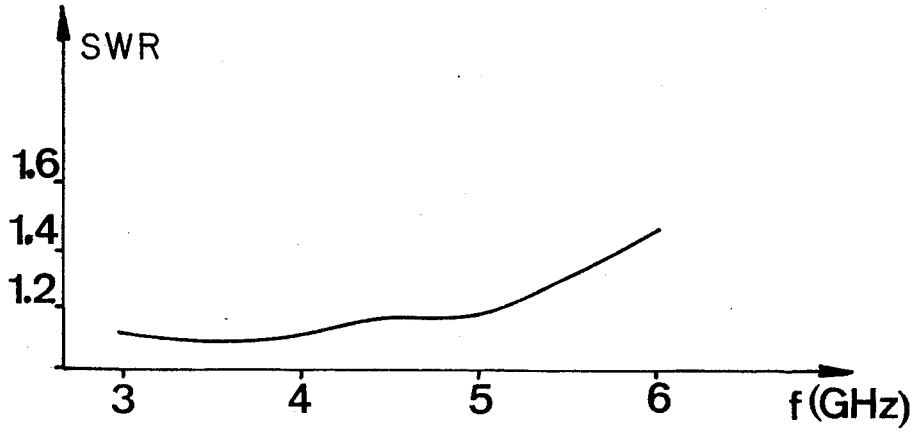
Fig:3 dB
25
20
15
10
5
45
43
41
42
44
46
3
4
5
6
f(GHz)

dB
30
20
10
52
51
3
4
5
6
f(GHz)

dB
25
20
15
10
5
62
61
0.07
0.13
0.20
0.27
0.33
(H/Hres)

NON-RECIPROCAL BROADBAND SLOT LINE DEVICE

BACKGROUND OF THE INVENTION

The invention relates to a microwave device in which the electromagnetic waves propagates in a non-reciprocal manner, due to a magnetised gyromagnetic medium located in the propagation path.

In non-reciprocal devices, the direction along which propagation is achieved with low loss (insertion loss) will be called the "direct direction" according to current practice, while the opposite direction along which high attenuation is obtained (isolation) will be called the "reverse direction."

PRIOR ART

It is known that the magnetic field of a microwave being propagated in a slot line is located in a plane, perpendicular to the line, containing the axis of the slot. It is also known that the polarisation of the magnetic field is elliptical, at the same time in the substrate and in the air surrounding the line, and that moreover this property is necessary for the non-reciprocal propagation.

U.S. Pat. No. 3,602,845, filed on the 27th Jan. 1970 by AGRIOS and LIPETZ, and entitled "Slot line non-reciprocal phase shifter" describes a non-reciprocal arrangement with a slot line, as shown in FIG. 1 herein, reproduced from said patent. The substrate 10 consists of ferrite, the arrow H of the figure representing the direction of the external magnetising magnetic field. The slot line 12 is formed by two metal strips 14 coating the substrate 10. An electromagnetic wave being propagated along the line 12 comprises a magnetic field, the lines of which are represented at 17, which is perpendicular to the electric field.

BRIEF DISCLOSURE OF THE INVENTION

The object of the present invention is to provide a non-reciprocal component providing an isolation at least equal to 20 dB in a broad bandwidth.

The non-reciprocal component according to the invention comprising such parts as a flat slot line and a thin gyromagnetic plate parallel to the said line, within in the microwave field of this latter, magnetised by a d.c. field which is perpendicular to the slot and parallel to the plane of the slot line, is characterised in that it comprises, at least, attenuation means placed against that free face of the said plate which is furthest from the said slot line, the dimensions of the said parts being such that the following relationships are met:

the thickness $h$ of the said plate is larger than $3l$, $l$ being the width of the slot;

the length L of the said plate is at least equal to a half wave length, measured in the slot line at the maximum operating frequency;

the intensity H of the d.c. magnetic field in the plate is between 0.05 $H_{res.}$ and 0.5 $H_{res.}$, where $H_{res.}$ is the resonance field of the material forming the plate.

According to a modification of the invention, the said slot line is deposited on a low loss alumina substrate at most equal $2l$ thick, fastened to the said plate of gyromagnetic material.

The non-reciprocal component according to the invention has the following advantages:

its bandwidth is large (about one octave);

the difference between the insertion loss (in the direct sense) and the isolation (in the inverse sense) is greater than 20 dB, even with an arrangement of which the length equals a half wavelength in the slot line;

the insertion loss of the arrangement can be kept below 2 dB;

the interconnection is easy and the connections show a low standing wave ratio in the bandwidth;

the value of the intensity H of the d.c. magnetic field necessary for the operation of the device is not critical.

DETAILED DESCRIPTION OF THE INVENTION

Other features and advantages of the non-reciprocal device according to the invention will be more clearly apparent from the description illustrated by reference to the drawings which are given simply by way of illustration and without any limiting character, and in which:

FIG. 1 represents a prior art device;

FIG. 2*a* and 2*b* respectively represent a transverse section and a longitudinal section of a non-reciprocal device according to the invention, operated as an isolator;

FIG. 3 represents the variation of the S.W.R. at the input of the device as a function of the frequency;

Figure 8:
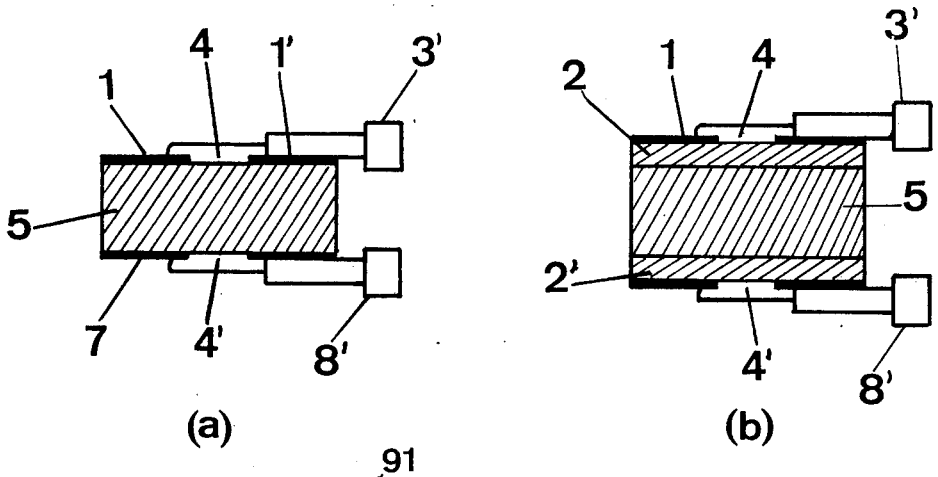
Figure 9:
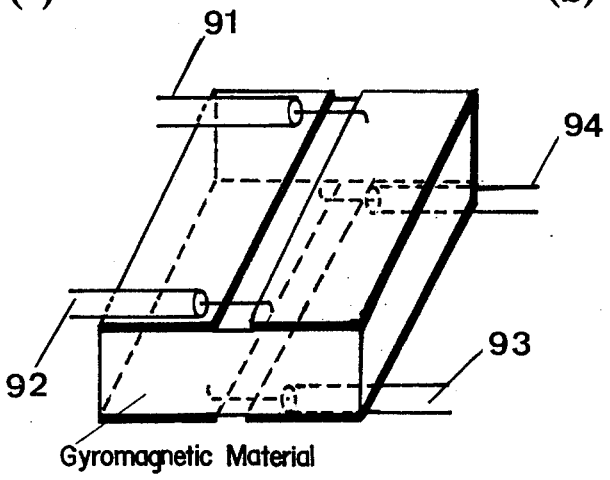

FIG. 7*a* represents a transverse section of a first modified form of an isolator according to the invention;

FIG. 7*b* represents the variation curve of the maximum amplitude of the electric field as a function of the distance to the slot line;

FIGS. 8*a* and 8*b* represent two transverse sections of a second and a third modified construction of isolators according to the invention;

FIG. 9 represents a circulator according to the invention;

FIGS. 10*a*, 10*b*, 11*a* and 11*b* represent four transverse sections of modified forms of isolators according to the invention.

FIG. 2*a* is a transverse section of an isolator according to the invention and FIG. 2*b* is a longitudinal section along a plane passing through the axis of the slot and perpendicular to the sectional plane of FIG. 2*a*. The slot line is formed of two metallic strips 1 and 1' directly deposited on a thin plate 5 of low loss gyromagnetic material. Two coaxial plugs 3 and 3' are connected to the metallic strips, for example, the outer leads to the strip 1', such as that represented in the Figures, and the inner conductors to the strip 1. The thickness $h$ of the thin plate 5 is larger than three times the width $l$ of the slot 4 which separates the metallic strip 1 and 1'. Disposed against the face of the plate 5 opposite the slot 4 of the line is a plate 6 having a thickness at least equal to $2l$, made of lossy material. As a lossy material, it is usual to employ fine metallic powder, for example iron powder, dispersed in epoxy resin.

There will now be described an isolator according to the invention developed in the 3 to 6 GHz band. In this isolator, the slot line is formed by two metallic strips deposited on a substrate of low loss gyromagnetic material, 4 millimeters thick. These two metallic strips, separated by a slot 1 millimeter thick are connected to two miniaturised coaxial plugs with an impedance of 50 ohms and spaced by 50 millimeters. As no particular arrangement has been taken for achieving a good adaptation towards the high frequencies of the bandwidth the values given in FIG. 3 should not in any case represent an optimum values and are only given as an illustration. This figure represents the variations of the S.W.R., measured at the plug 3, as a function of the frequency, when the output 3' is connected to a matched load.

The gyromagnetic material which is used for the thin plate 5 is an yttrium, gadolinium, aluminium garnet. The external d.c. magnetic field applied to the garnet is $4.10^4$ A/m.

Figure 4:
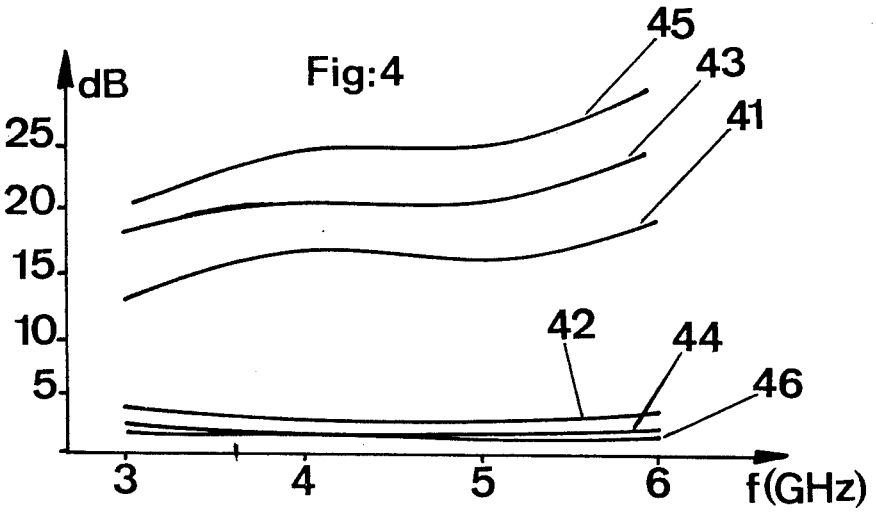
FIG. 4 represents the variation of the insertion loss and of the isolation of an isolator according to the invention, as a function of the frequency, for several values of the ratio $h/l$.

FIG. 4 represents at 41 and 42 the variations, as a function of the frequency, of the attenuation in the reverse sense and in the direct sense of an isolator having a ratio $h/l$ equal to 1. Despite the presence of the attenuating plate 6, the isolation which is obtained remains low. In the same figure, the curves 43 and 44 represent the attenuation in the reverse and direct senses when the ratio $h/l$ is equal to 2.8. Curves 45 and 46 represent the variations of the same attenuations when the ratio $h/l$ is equal to 5. Comparison of these curves makes it apparent that the choice of a too small ratio $h/l$ only permits a non-reciprocal device to be obtained which behaves as a bad isolator, while on the contrary, the choice of a value of the ratio $h/l$ higher than 3 enables an isolation to be obtained, at least equal to 20 dB, when the other parameters are optimised.

Figure 5:
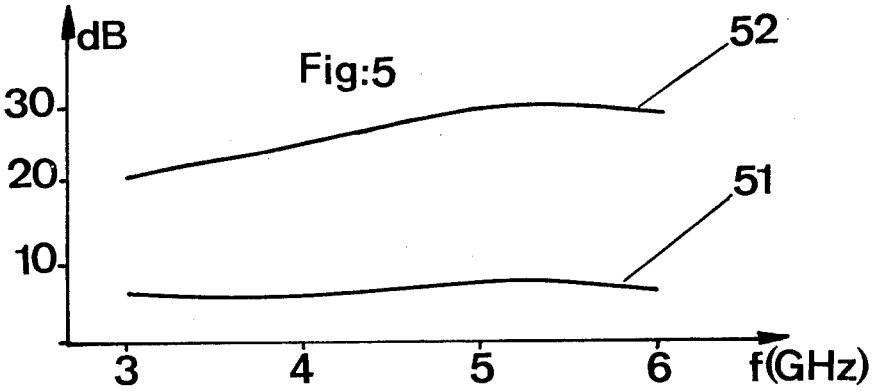
FIG. 5 represents the variation of the direct and reverse attenuation of the foregoing isolator, without an attenuating tongue.

FIG. 5 represents at 51 and 52 the variations, as a function of the frequency, of the direct and reverse attenuations of the same device as shown on the curves 45 and 46, without the attenuating plate 6. The comparison of these curves shows that the presence of the attenuating plate 6 is essential for the correct operation of the isolator.

Figure 6:
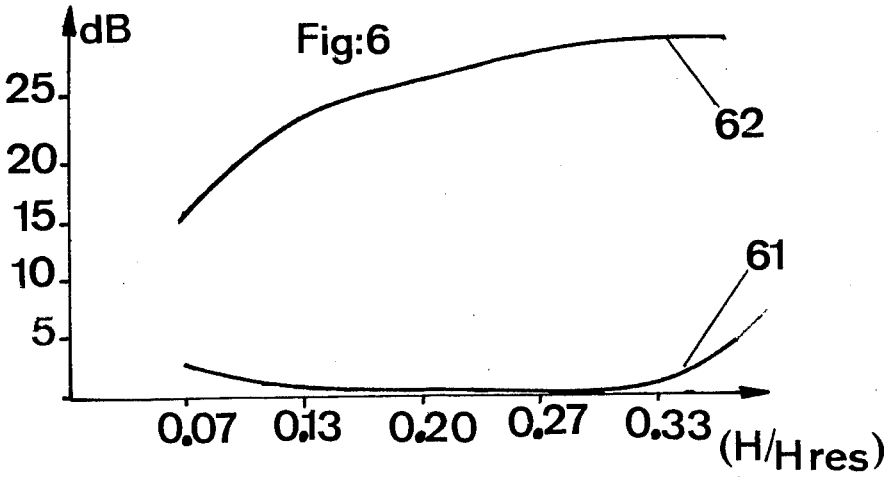
FIG. 6 represents a variation of the isolation as a function of the intensity of the external magnetic field.

FIG. 6 represents the variation of the direct attenuation (curve 61) and reverse attenuation (curve 62) as a function of the intensity of the magnetic field at fixed frequency. It appears that with values of $H/H_{res.}$ smaller than 0.05, the operation of the isolator becomes defective and that the same appears when $H/H_{res.}$ is higher than 0.35. On the contrary, when $H/H_{res.}$ is between 0.05 and 0.35, the value of H is not critical, and this simplifies the design of the magnetic circuit.

FIG. 7*a* represents a transverse section of a first modified form of the isolator according to the invention, in which the slot line rests on a substrate 2 with a thickness smaller than $2l$, of low loss non-magnetic dielectric, as for example alumina, sapphire, D.16 is a non-magnetic dielectric marketed under this name by the American company Transtech, at Gaithersburg, Maryland, the plate 5 of gyromagnetic material being for example glued on the face of the substrate opposite to that bearing the metallisation.

FIG. 7*b* represents at 71 the variation of the electromagnetic energy per unit of volume in the direct wave as a function of the distance to the plane of the slot line and at 72 the curve of the energy per unit of volume of the reverse wave. In order to reduce the insertion loss, it is advantageous to place a thickness $e$, as a maximum equal to $2l$, of non-magnetic low loss dielectric between the slot line and the plate of gyromagnetic material. Thereby a considerable part of the energy of the direct wave will propagate in a medium of which the losses are lower than that of the gyromagnetic material. On the other hand, this arrangement only affects very slightly the losses of the reverse wave, because these latter are located for a small part within the layer 5 and for a larger part in the plate 6. By way of illustration, the introduction into the previously described isolator of a 2 mm thick layer of low loss alumina reduces the maximum insertion loss from 3 dB to 1.5 dB in the bandwidth. FIG. 7*b* is shown in the case where the non-magnetic dielectric has the same dielectric constant as the gyromagentic material being used. This condition is met, for example, when the materials being used consist of a yttrium iron garnet associated with D.16. However, the equality of the two dielectric constants is not necessary for the good operation of the non-reciprocal component according to the invention.

FIGS. 8*a* and 8*b* represent the second and third modified forms of an isolator according to the invention, in which the attenuation means are formed by a second slot line 7 terminated by two coaxial plugs 8 (not shown) and 8', permitting each end of the line to be connected to a matched coaxial load (not shown).

When the slots have different widths, the bandwidths for which a good adaptation is obtained are different and this arrangement can be systematically employed for increasing the bandwidth in which the isolator can be operated by permutation of the two lines.

Figure 7:
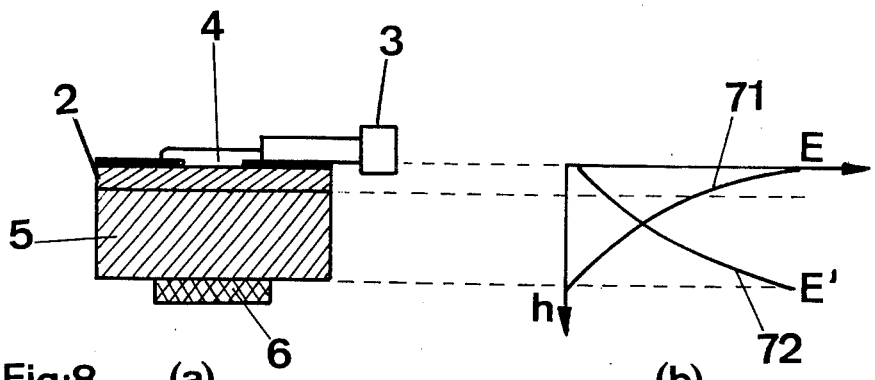

FIG. 8*a* relates to two slot lines deposited directly on a thin plate 5 of gyromagnetic material, whereas FIG. 8*b* shows two slot lines which are each deposited on a substrate of alumina 2 and 2', situated on either side of the plate 5 (see FIG. 7). The thickness of the plate 5 of gyromagnetic material is of course greater than $3l$, as previously stated so that the isolation of the isolator is higher than 20 dB.

When the slots 4 and 4' of the two lines have the same width, the isolator can be used by taking either one of these latter as the propagation line.

When the thickness of the plate of gyromagnetic material is between $3l$ and $6l$ (with $l$ equal to the width common to the two slot lines) and when the matched coaxial loads are replaced by external circuits having a S.W.R. close to 1, the non-reciprocal component according to the invention behaves like a circulator.

FIG. 9*a* represents a circulator, of which the two slot lines are directly deposited on a plate of yttrium garnet with a saturation moment equal to $1.24.10^5$ A/m, a thickness equal to 4.2 millimeters and a length equal to 50 millimeters. The width $l$ which is common to the two slots is 1 millimeter. This circulator operates in the band C (4 to 8 GHz) with an external d.c. magnetic field of $4.10^4$ A/m. It shows an insertion loss smaller than 3 dB and an isolation greater than 20 dB.

As for the isolator in FIG. 8*b*, it is possible to reduce the insertion loss by using a thickness $e$, at a maximum equal to $2l$, of low loss non-magnetic dielectric between each slot line and the plate of gyromagnetic material.

The numbering of the gates 91, 92, 93, 94 in FIG. 9 corresponds to the usual numbering 1, 2, 3, 4 of circulator devices. It is obvious that there is no change in the operation of the apparatus if the gates 93, 94, 91, 92 are substituted for the preceding gates in the order indicated.

Figure 10:
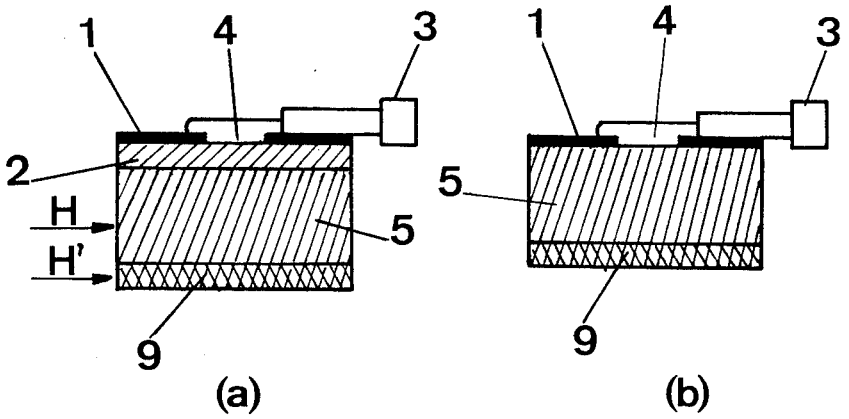

FIGS. 10*a* and 10*b* represent two modified forms of isolators according to the invention, in which the absorption is assured by a layer of a second gyromagnetic material 9, of which the saturation magnetisation moment is different from that of the first material, so that the applied external magnetic field causes the lossy operation of the layer 9.

Figure 11:
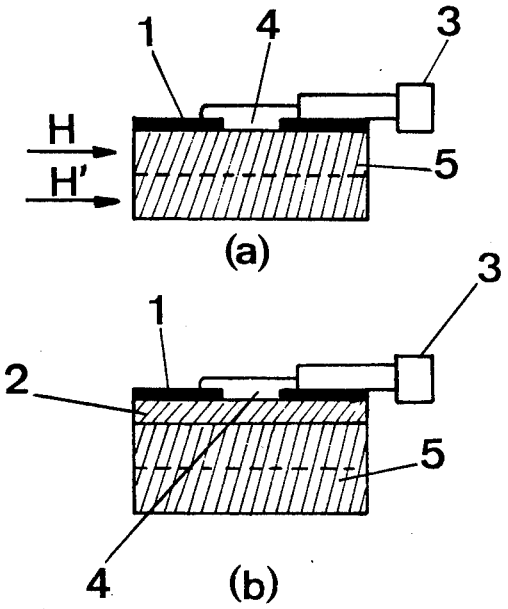

FIGS. 11*a* and 11*b* represent two modified forms of isolators, in which two different intensities H and H′ of the d.c. magnetic field are applied to two zones of the layer of gyromagnetic material 5 as shown in FIG. 11*a*. The intensity H, which is between 0.05 and 0.5 $H_{res.}$, is applied to a zone the thickness of which is between 3 and 6*l*. The intensity H′, smaller than 0.05 $H_{res.}$, is applied to a zone having a thickness at least equal to 2*l* spaced further from the slot line than the first zone. In the modified form of FIG. 11*a*, the line rests directly on the plate of gryomagnetic material 5. In the modified form of FIG. 11*b*, it rests on a non-magnetic dielectric substrate 2.

What we claim:

1. A wideband non-reciprocal microwave device comprising:

a planar slot line formed of two metallic strips having a slot therebetween, a plate oriented parallel to said planar slot line and placed within the microwave field of said planar slot line, said plate made of gyromagnetic material, magnetized by a d.c. magnetic field both perpendicular to the slot and parallel to the plane of the slot line, at least one attenuation means placed against the face of the said plate which is most remote from the said slot line, wherein:

said slot has a width *l*, said plate has a thickness *h* and a length L, the thickness *h* of the said plate is larger than 3*l*, and the length L of the said plate is at least equal to a half wave length measured in the slot line at the maximum operating frequency.

2. A device as recited in claim 1 wherein said slot line is directly deposited on the plate of gyromagnetic material.

3. A device as recited in claim 1, in which said slot line is deposited on a substrate of low loss non-magnetic dielectric of a thickness at most equal to 2*l*, fixed on said plate of gyromagnetic material.

4. A device as recited in claim 1 wherein said attenuation means is formed by a plate of lossy material, having a large dimension parallel to the slot of said line.

5. A device as recited in claim 1, in which said attenuation means is formed by a plate of a second gyromagnetic material with high losses when magnetized by said magnetic field.

6. A device as recited in claim 1 wherein the value of said d.c. magnetic field is between 0.05 $H_{res}$ and 0.35 $H_{res}$, where $H_{res}$ is the value of the resonance field for the plate material at the central frequency of the bandwidth.

7. A device as recited in claim 1, wherein said attenuation means comprises a second slot line parallel to said planar slot line and connected to each end of a matched dissipative load.

8. A device as recited in claim 7, in which the slot of the second line is wider than that of said planar slot line.

9. A device as recited in claim 7, in which the slots of the two lines have the same width.

10. A device as recited in claim 1, in which said attenuation means is formed by a portion of the plate of gyromagnetic material spaced further from the slot line, said plate portion having a thickness at least equal to 2*l*, and subjected to a magnetic field with an intensity lower than 0.05 $H_{res}$, where $H_{res}$ is the value of the resonance field for the plate material at the central frequency of the bandwidth.

11. A device as recited in claim 10 wherein the total thickness of the plate is at least 5*l*.

12. A device as recited in claim 1, wherein said attenuation means comprises a second slot line identical with said planar slot line, disposed on the opposite face of the plate of gyromagnetic material, facing said planar slot line.

13. A device as recited in claim 12, in which the thickness of the plate of gyromagnetic material is between 3*l* and 6*l*.

* * * * *